US009093230B2

(12) United States Patent
Sisley et al.

(10) Patent No.: US 9,093,230 B2
(45) Date of Patent: Jul. 28, 2015

(54) HIDDEN/SLIDING DOOR SYSTEM FOR FIELD-INSTALLED ACCESSORY ACCESS

(71) Applicant: EATON CORPORATION, Cleveland, OH (US)

(72) Inventors: James Patrick Sisley, Baden, PA (US); Richard Paul Malingowski, McDonald, PA (US); Kelly Julia McCarthy, Pittsburgh, PA (US); Lance Gula, Clinton, PA (US); Craig Allen Rodgers, Moon Township, PA (US); Keith Edward Thomas, Burgettstown, PA (US); Thomas Alan Whitaker, North Huntingdon, PA (US)

(73) Assignee: EATON CORPORATION, Cleveland, OH (US)

( * ) Notice: Subject to any disclaimer, the term of this patent is extended or adjusted under 35 U.S.C. 154(b) by 209 days.

(21) Appl. No.: 13/962,996

(22) Filed: Aug. 9, 2013

(65) Prior Publication Data

US 2015/0041290 A1 Feb. 12, 2015

(51) Int. Cl.
*H01H 9/28* (2006.01)
*H01H 71/02* (2006.01)

(52) U.S. Cl.
CPC ..... *H01H 9/287* (2013.01); *H01H 71/0214* (2013.01); *H01H 71/0228* (2013.01); *H01H 71/0264* (2013.01); *H01H 2223/044* (2013.01); *H01H 2223/048* (2013.01)

(58) Field of Classification Search
CPC ..... H01H 9/287; H01H 2223/044; H01H 2223/048
USPC ..... 200/43.22, 43.14, 19.21, 19.26, 19.27
See application file for complete search history.

(56) References Cited

U.S. PATENT DOCUMENTS

| | | | | |
|---|---|---|---|---|
| 4,595,812 | A * | 6/1986 | Tamaru et al. | 200/307 |
| 5,140,115 | A | 8/1992 | Morris | |
| 6,480,082 | B1 | 11/2002 | Aihara et al. | |
| 7,012,493 | B1 | 3/2006 | Marks et al. | |

FOREIGN PATENT DOCUMENTS

| | | | |
|---|---|---|---|
| EP | 0 138 429 | A2 | 4/1985 |
| JP | H06111707 | A | 4/1994 |

OTHER PUBLICATIONS

European Patent Office, "International Search Report and Written Opinion", Oct. 7, 2014, 9 pp.

* cited by examiner

*Primary Examiner* — Edwin A. Leon
*Assistant Examiner* — Iman Malakooti
(74) *Attorney, Agent, or Firm* — Eckert Seamans Cherin & Mellott, LLC; David C. Jenkins

(57) ABSTRACT

An electrical switching apparatus housing assembly for an electrical switching apparatus assembly is provided. The electrical switching apparatus housing assembly including a body assembly and a movable door member. The body assembly includes a number of outer sidewalls. The outer sidewalls define an enclosed space. The outer sidewalls include a top sidewall. The top sidewall includes a limited opening to the enclosed space. The movable door member is movably coupled to the top sidewall. The door member is movable between an open, first position, wherein the door member is not disposed in the limited opening, and a closed, second position, wherein the door member is disposed in the limited opening.

20 Claims, 12 Drawing Sheets

HIDDEN/SLIDING DOOR SYSTEM FOR FIELD-INSTALLED ACCESSORY ACCESS

BACKGROUND OF THE INVENTION

1. Field of the Invention

The disclosed and claimed concept relates generally to electrical switching apparatus and, more particularly, to a housing assembly for an electrical switching apparatus wherein a movable door provides access to a vault.

2. Background Information

Electrical switching apparatus include, for example, circuit switching devices, circuit interrupters, such as circuit breakers, network protectors, contactors, motor starters, motor controllers, and other load controllers. Electrical switching apparatus such as circuit interrupters and, in particular, circuit breakers of the molded case variety, are well known in the art. Circuit breakers are used to protect electrical circuitry from damage due to an over current condition, such as an overload condition or a relatively high level short circuit or fault condition. Molded case circuit breakers typically include a pair of separable contacts per phase. The separable contacts may be operated either manually by way of a handle disposed on the outside of the case or automatically in response to an over current condition.

In an exemplary embodiment, circuit breakers include an operating mechanism, which is designed to rapidly open and close the separable contacts, a trip unit, which senses over current conditions, and a trip actuator assembly. The trip actuator is actuated by the trip unit in response to an over current condition and moves the operating mechanism to a trip state. In the trip state the separable contacts move to their open position.

The electrical switching apparatus housing assembly includes a non-conductive body, e.g. the "molded case" noted above. The housing assembly includes a base member and a cover member or assembly. The base member defines a number of cavities into which the other components are disposed. The base member is coupled to either the cover member or the cover assembly thereby substantially enclosing the components. A cover member is a generally planar member that covers the entire base member. A cover assembly includes a thicker body that also defines a number of cavities. The cover assembly body may be a unitary body, or, the cover assembly may further include a planar cover member that is coupled to the cover assembly body. Cover members and cover assemblies generally have the same cross-sectional area as the base member. In this configuration, accessing the housing assembly enclosed space required the user to separate the base member and the cover assembly, or cover member, thereby exposing the entire enclosed space to infiltration by dirt and debris.

It is also known to provide accessory components for an electrical switching apparatus. An accessory component is coupled to the operating mechanism or trip unit. An accessory component is disposed in a cavity, also identified as a vault, within the cover assembly body. To access the vault a user would either have to remove a cover member or a smaller vault door. As noted above, removal of a cover member opened the entire cover assembly body cavity. A door, while smaller than a cover member, was typically disposed over the vault as opposed to in the limited opening associated with the vault. For example, the door was a planar member that pivoted between an open position and a closed position. Such doors are prone to open during a trip event or fault interruption event. That is, during a trip event, an arc may heat the air and adjacent breaker components causing a rapid expansion of gas in the housing assembly enclosed space. The rapid expansion of the gas caused the pivoting doors to open, thereby exposing the vault.

There is, therefore, a need for a vault door member that is disposed in the limited opening and which is resistant to unintentional opening. There is a further need for such a door member to be easily incorporated into existing housing assembly configurations.

SUMMARY OF THE INVENTION

These needs, and others, are met by at least one embodiment of the disclosed and claimed concept which provides an electrical switching apparatus housing assembly for a electrical switching apparatus assembly. The electrical switching apparatus housing assembly includes a body assembly and a movable door member. The body assembly includes a number of outer walls. The outer walls define an interior space. The outer walls include a top sidewall. The top sidewall includes a limited opening to the interior space. The movable door member is movably coupled to the top sidewall. The door member is movable between an open, first position, wherein the door member is not disposed in the limited opening, and a closed, second position, wherein the door member is disposed in the limited opening.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
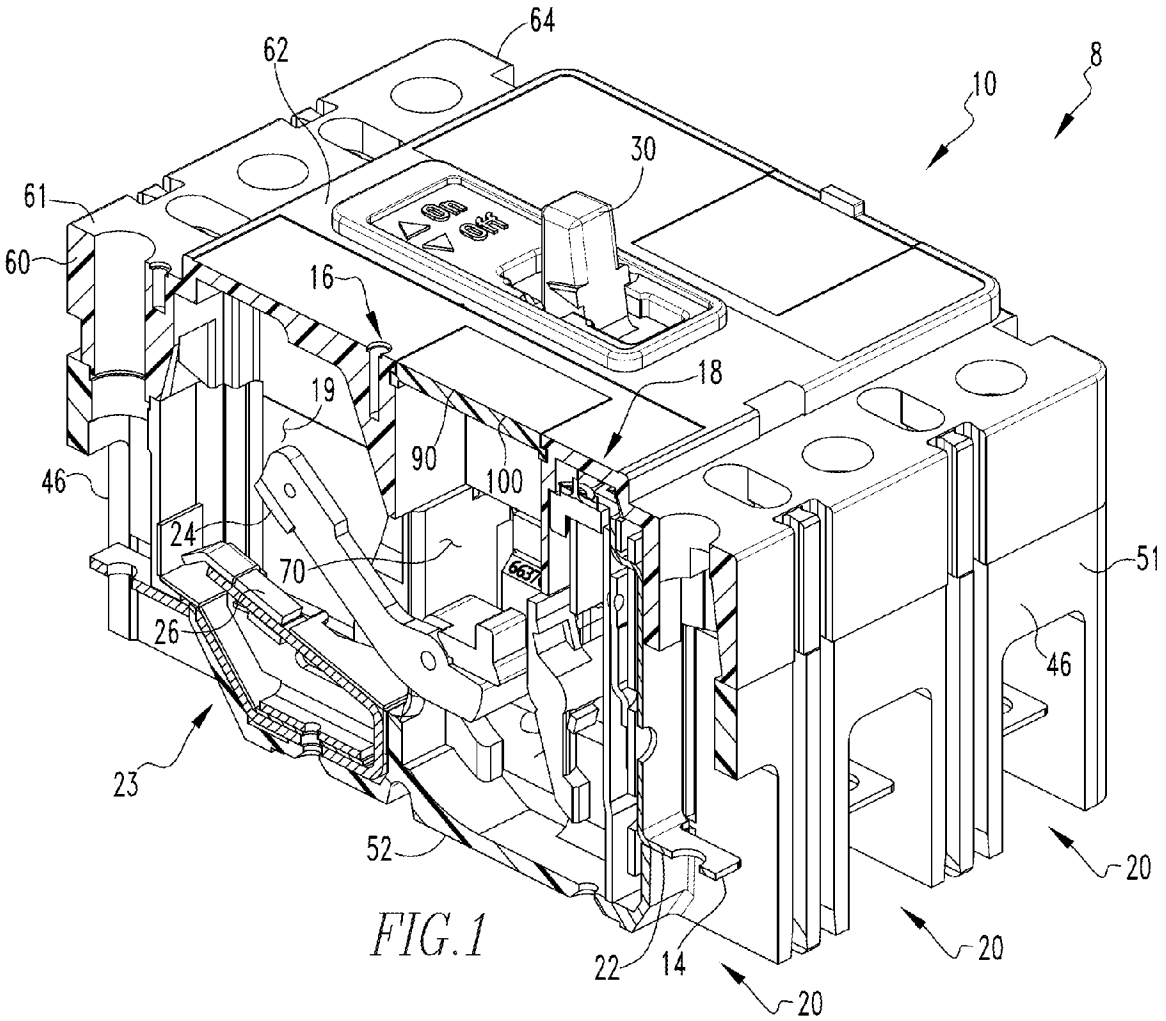
FIG. 1 is an isometric view of an electrical switching apparatus.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the statement that two or more parts or components "engage" one another shall mean that the elements exert a force or bias against one another either directly or through one or more intermediate elements or components.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies.

As used herein, an "accessory component" is a removable, or selectively installed, component that is structured to interact with other elements of an electrical switching apparatus. Accessory components include, but are not limited to auxiliary switches, bell alarms, shunt trips and under voltage releases.

As used herein, the "enclosed space" of a circuit breaker means the space bounded by the outer sidewalls of the circuit breaker. As used herein, a "vault" is a space within the "enclosed space."

As used herein, a "door member" is a construct that is structured to be moved between a number of positions including an open, first position and a closed, second position. Further, a "door" provides access to a portion of an enclosed space, but has a smaller cross-sectional area than the enclosed space. Conversely, as used herein, a "movable cover" is a movable construct that covers an enclosed space and has a cross-sectional area substantially equal to the cross-sectional area of the enclosed space. Thus, when moved, a "movable cover" provides access to the entire enclosed space behind the movable cover. An electrical switching apparatus may include multiple covers which are, in an exemplary embodiment, stacked. As used herein, a "removable cover" is not a "door."

As used herein, a "limited opening" is an opening that provides access to an enclosed space, but, wherein the "limited opening" has a cross-sectional area that is smaller than the enclosed space with which it is associated.

As used herein, "in," when used to describe a door disposed "in" a limited opening means that the door is substantially disposed in the plane of the planar member defining the limited opening. That is, the "plane" has a thickness and the door is disposed within the space including the plane's thickness. If the surface defining the limited opening is non-planar, then a door disposed "in" such a non-planar limited opening substantially follows the contour of the non-planar surface. By way of a non-limiting example, if the surface defining the limited opening is generally spherical, then the door is also generally spherical and generally has the same curvature as the generally spherical surface defining the limited opening. Thus, a door that covers a limited opening, e.g. wherein the door is slightly larger than the limited opening and is disposed over the limited opening, is not disposed "in" the limited opening. Similarly, a door having a greater thickness wherein a portion of the door is in the plane of the limited opening and a portion of the door extends above or below the plane of the limited opening, is not "in" the limited opening.

As used herein, a "snap-fit coupling" means a coupling that is, typically, temporary and wherein two coupling components, one of which is at least minimally flexible, are maintained in a coupled configuration due to a bias created by the minimally flexible component. As is known, the minimally flexible body typically engages the other component with a "snap" or "click" sound.

As used herein, a "channel" is a passage defined by a construct including at least two opposing elements. In an exemplary embodiment, a "channel" is defined by two spaced, generally parallel planar members. In another exemplary embodiment, a U-shaped groove is a "channel" (the tips of the "U" are the opposing elements). In another exemplary embodiment, two channels, e.g. opposing U-shaped constructs, define another "channel" (the grooves, especially the bottom of the grooves, are the opposing elements). These exemplary embodiments are non-limiting.

As used herein, an "orienting door member" is a door member that fits in an associated opening in one orientation. The door member may have an asymmetrical shape about a number of axes, e.g. a trapezoidal shape, or, the door member may be coupled to another element, e.g. an accessory component that is asymmetrically disposed on the orienting door member and that is disposed in an associated opening behind the orienting door member.

As shown in FIG. 1, and as is known, an electrical switching apparatus 8, such as, but not limited to a circuit breaker 10, includes an electrical switching apparatus housing assembly 12, a conductor assembly 14, an operating mechanism 16, a trip assembly 18, (elements shown schematically) as well as other components. The electrical switching apparatus housing assembly 12 is made from a non-conductive material and defines an enclosed space 19 wherein the other components may be disposed. The electrical switching apparatus housing assembly enclosed space 19 is, in an exemplary embodiment, divided into a number of cavities 20.

The conductor assembly 14 includes a number of conductive elements 22 (shown schematically) that extend through the electrical switching apparatus housing assembly 12. The conductive elements 22 extend in a longitudinal direction through the electrical switching apparatus housing assembly 12. As shown schematically, a number of conductive elements 22 include, but are not limited to a pair of contacts 23 including a movable contact 24 and a fixed contact 26. Each movable contact 24 is structured to move between an open, first position, wherein the movable contact 24 is spaced from the fixed contact 26, and, a closed, second position, wherein the movable contact 24 is directly coupled to, and in electrical communication with, the fixed contact 26.

The operating mechanism 16 is coupled to each movable contact 24 and is structured to move each movable contact 24. The operating mechanism 16 moves between a number of configurations including an open, first configuration, wherein each movable contact 24 is spaced from an associated fixed contact 26, and, a closed, second configuration, wherein each movable contact 24 is directly coupled to, and in electrical communication with, the associated fixed contact 26. The operating mechanism 16 includes biasing elements (not shown) such as, but not limited to springs (not shown), that bias the operating mechanism 16 to the first configuration. Thus, the contacts 24, 26 are biased to the open, first position. The operating mechanism 16 includes a handle 30 that may be used to move the contacts 24, 26 between the first and second positions. In an exemplary embodiment, the handle 30 moves to a reset position, thereby moving the operating mechanism 16 into a reset configuration, as is known. Handle 30 extends through an opening in top sidewall 62. The handle 30 moves, and in an exemplary embodiment, pivots about its lower end in a plane hereinafter identified as the "handle longitudinal plane."

The electrical switching apparatus housing assembly 12 includes a body assembly 44. Body assembly 44 includes a base member 50 and a cover assembly 60. In an exemplary embodiment, base member 50 is a unitary body 51 including a bottom sidewall 52, a number of outer sidewalls 54, and a number of internal sidewalls, not shown. Cover assembly 60 includes a body 61 with a generally planar top sidewall 62, a number of outer sidewalls 64, and a number of internal sidewalls 66, shown schematically. Cover assembly 60 is sized and shaped to substantially correspond to base member 50 and is coupled thereto. When cover assembly 60 is coupled to base member 50, the base member outer sidewalls 54 generally align, i.e. are disposed in the same general plane as, the cover assembly outer sidewalls 64. Thus, the base member outer sidewalls 54 and the cover assembly outer sidewalls 64 are collectively identified as the body assembly outer sidewalls or, as used herein, "outer sidewalls 46." Similarly, the base member internal sidewalls 56 and the cover assembly internal sidewalls 66 are generally aligned and are collectively identified as body assembly internal sidewalls, or, as used herein, "internal sidewalls 48." The outer sidewalls 46 along with the base member 50 and the top sidewall 62 define the enclosed space 19. The internal sidewalls 48 divide the enclosed space 19 into cavities 20. The operating mechanism 16 and the conductor assembly 14 are substantially disposed within the cavities 20.

Figure 2:
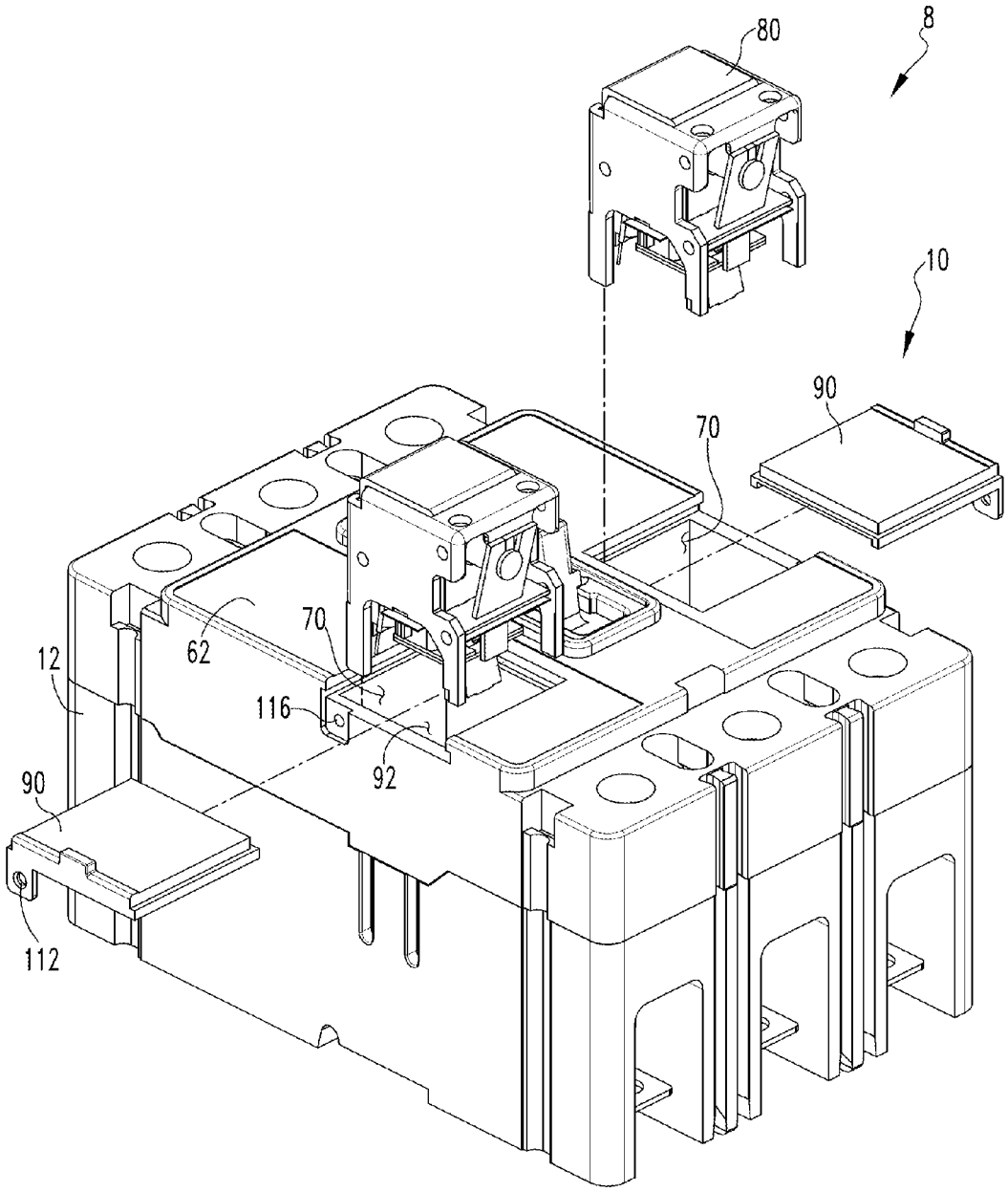
FIG. 2 is an isometric view of an electrical switching apparatus with open vaults.

In an exemplary embodiment, as shown in FIG. 2, the cover assembly outer sidewalls 64 have a height, i.e. a dimension generally perpendicular to the plane of the top sidewall 62. In this configuration, the cover assembly 60 also defines a number of pockets, hereinafter "vaults 70" which are a portion of the cavities 20. When cover assembly 60 is coupled to base member 50 the vaults 70 are contiguous with and open to the other portions of the cavities (not shown). In an alternate embodiment, the vault 70 includes a lower member that extends generally parallel to the top sidewall 62. The lower member, however, includes a number of openings that provide access to the other portions of the cavities. Thus, an accessory component 80 disposed in a vault 70 may engage or otherwise be coupled to or directly coupled to the operating mechanism 16, conductor assembly 14 and/or trip assembly 18. Accordingly, each accessory component 80 moves between an uninstalled, first position, wherein the accessory component 80 is disposed outside an associated vault 70, and an installed, second position, wherein the accessory component 80 is coupled to the operating mechanism 16.

Figure 3:
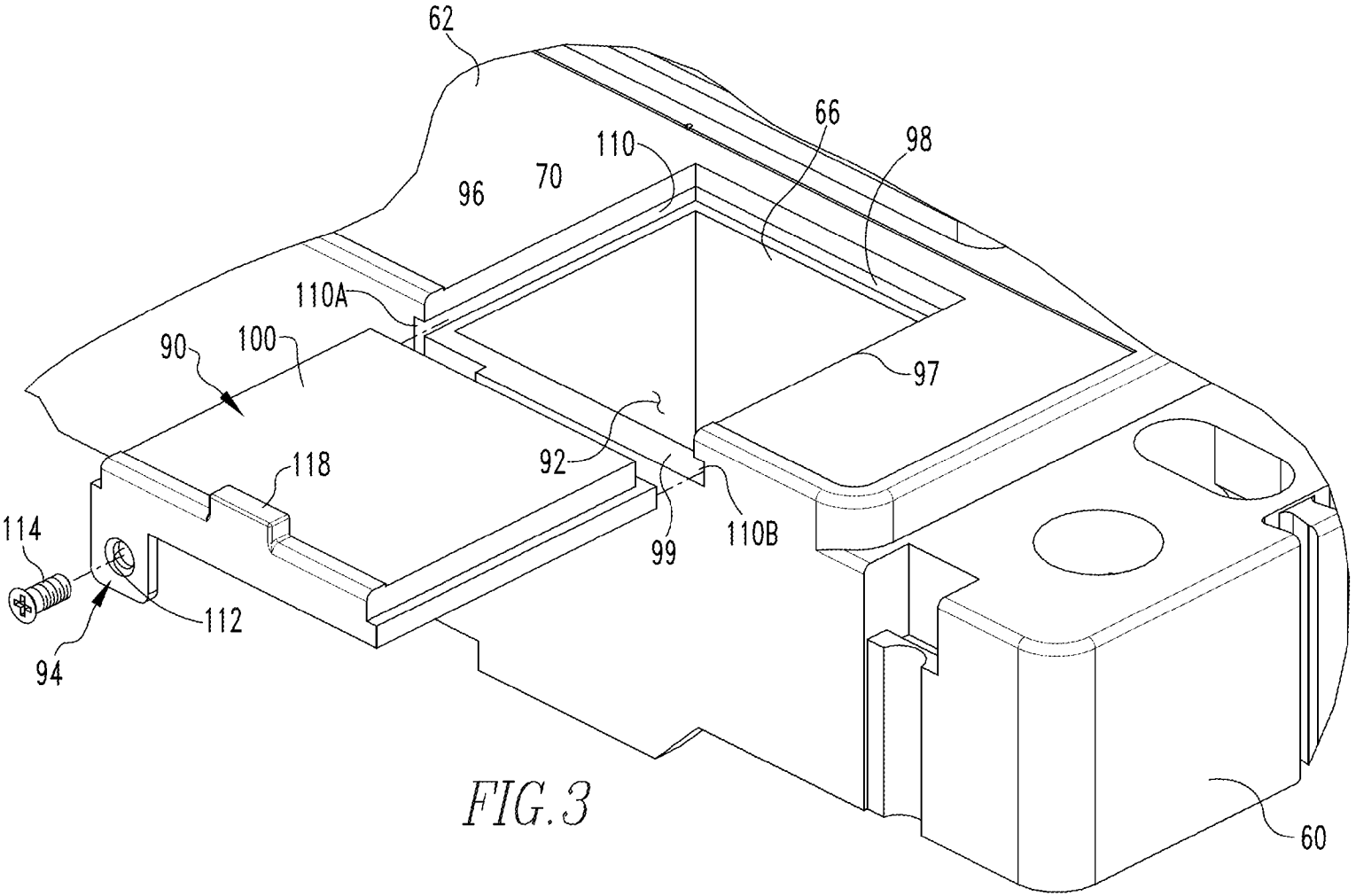
FIG. 3 is a detail isometric view of a vault and door member.

The cover assembly 60 further includes a number of movable door members 90 and a number of limited openings 92, as shown in FIGS. 2 and 3. Hereinafter, a single door member 90 and limited opening 92 will be discussed, but it is understood that the electrical switching apparatus housing assembly 12, or the body assembly 44, can include more than one of each. The limited opening 92 is an opening to a vault 70. In an exemplary embodiment, the cross-sectional shape of the limited opening 92 is a parallelogram, e.g. a square or a rectangle. In this configuration, the limited opening 92 includes four sides; a front side 96, a back side 97, an inner lateral side 98 and an outer lateral side 99. The front side 96 and the back side 97 extend generally perpendicular to the handle longitudinal plane, and, the inner lateral side 98 and the outer lateral side 99 extend generally parallel to the handle longitudinal plane.

The door member 90 is movable between an open, first position, wherein the door member 90 is not disposed in the limited opening 92, and a closed, second position, wherein the door member 90 is disposed in the limited opening 92, as shown in FIG. 1. In an exemplary embodiment, the limited opening 92 is defined by the generally planar top sidewall 62. Thus, in an exemplary embodiment, the door member 90 is also generally planar. The door member 90 further includes a locking component 94, which is one component of a locking coupling assembly, as discussed below.

In an exemplary embodiment, the movable door member 90 is a translating door member 100 and is slidably coupled to the top sidewall 62. That is, the translating door member 100 maintains substantially the same orientation relative to the top sidewall 62 as the translating door member 100 moves between the first and second positions. As noted below, the translating door member 100 may tilt slightly and still maintain substantially the same orientation relative to the top sidewall 62.

In an exemplary embodiment, the top sidewall 62 defines a number of channels 110. The number of channels 110 are disposed adjacent the limited opening 92. That is, the cover assembly 60 defines two elongated channels 110A, 110B disposed on opposing sides of the limited opening 92; as shown, the front side 96 and the back side 97. Thus, as shown, the channels 110A, 110B extend generally perpendicular to the handle longitudinal plane. In this configuration the door member 90 moves, and more specifically translates, generally linearly in a direction substantially perpendicular to the operating mechanism handle plane of motion.

Further, as shown, in an exemplary embodiment, the door locking component 94 is an opening 112 through which a fastener 114 extends. That is, the cover assembly 60 includes a threaded opening 116. When the door member 90 is in the second position, the door locking component 94, i.e. opening 112, aligns with threaded opening 116. Fastener 114 is passed through the door locking component 94 and coupled to the threaded opening 116. In this configuration, the door member 90 is secured on three sides, i.e. the door member 90 is secured by the channels 110A, 110B disposed on the limited opening front side 96 and back side 97, as well as by the fastener 114 on the outer side (the side away from the handle 30). Further, in this embodiment, door member 90 includes a tab 118 disposed on a side that extends substantially parallel to the operating mechanism handle plane of motion.

In an alternative embodiment, not shown, the door locking component 94 is a snap-fit ball-and-detent configuration. That is, a hemisphere, or "ball," is disposed on a narrow side of the translating door member 100. Further, a channel 110 includes a detent wherein, when the translating door member 100 is in the second position, the ball and detent align. In this embodiment, the translating door member 100 is slightly flexible so as to accommodate the ball as it travels through the channels 110A, 110B.

Figure 4:
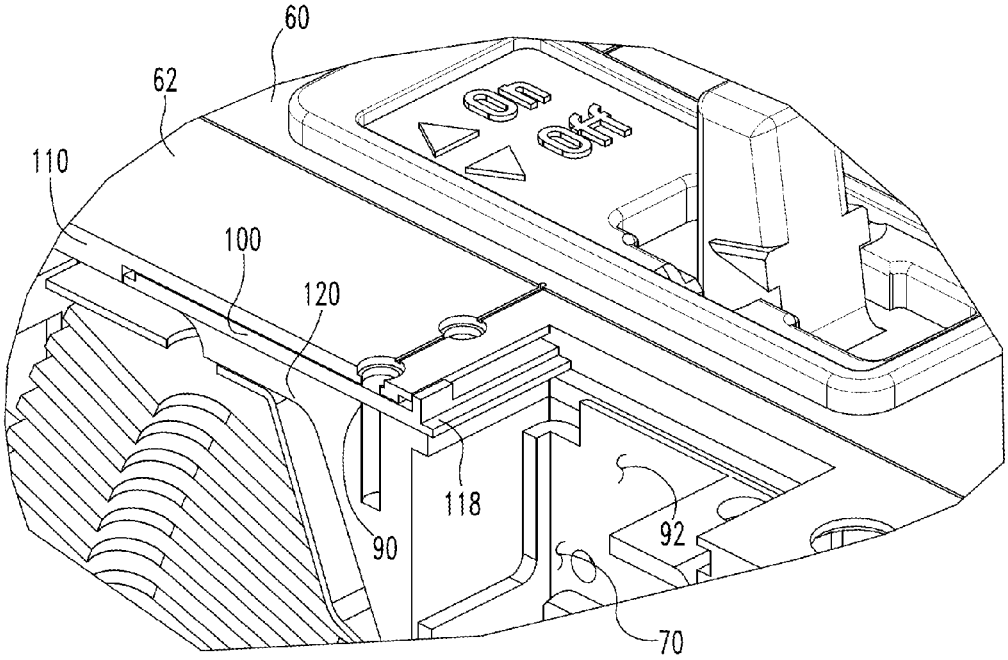
FIG. 4 is an isometric view of an alternate embodiment of an electrical switching apparatus with the door member in the first position.
Figure 5:
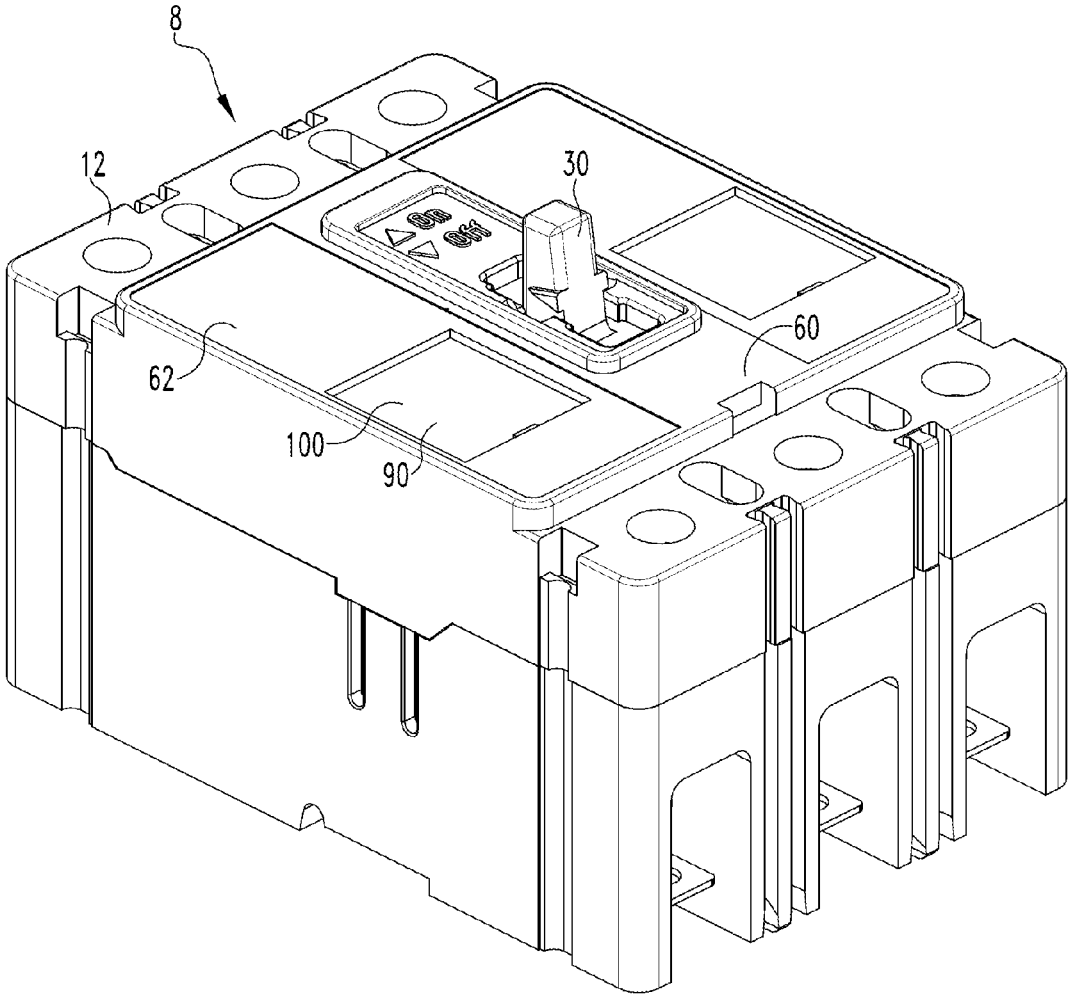
FIG. 5 is an isometric view of an alternate embodiment of an electrical switching apparatus with the door member in the second position.

In an alternate embodiment, shown in FIGS. 4 and 5, the translating door member 100 moves in a direction substantially parallel to the handle longitudinal plane. In FIG. 4, the translating door member 100 is shown in the first position and in FIG. 5 the translating door member 100 is shown in the second position. In this exemplary embodiment, there is a single channel 110. The channel 110 is defined by the inner surface of the top sidewall 62 as well as an inner planar member 120. That is, in this exemplary embodiment, cover assembly 60 includes a generally planar, inner member 120 that is disposed in a plane generally parallel to, but spaced from, the top sidewall 62 and within the enclosed space 19. The spacing between the top sidewall 62 and the inner member 120 generally corresponds to the thickness, or is slightly greater than the thickness of, the translating door member 100. The translating door member 100 moves from a first position, wherein the translating door member 100 is disposed between the top sidewall 62 and the inner member 120, to a second position, wherein the inner member 120 is substantially disposed in the limited opening 92.

In this embodiment, the top sidewall 62 as well as the inner planar member 120 define the limited opening 92. Further, the channel 110, in an exemplary embodiment, extends on either side of the limited opening 92. Thus, as used herein with respect to this embodiment, the top sidewall 62 and the inner planar member 120 are, collectively, "the planar member defining the limited opening." Thus, although the translating door member 100 is thinner than the planar member defining the limited opening, the translating door member 100 is disposed "in" the plane of the planar member defining the limited opening 92 when in the second position.

Figure 6:
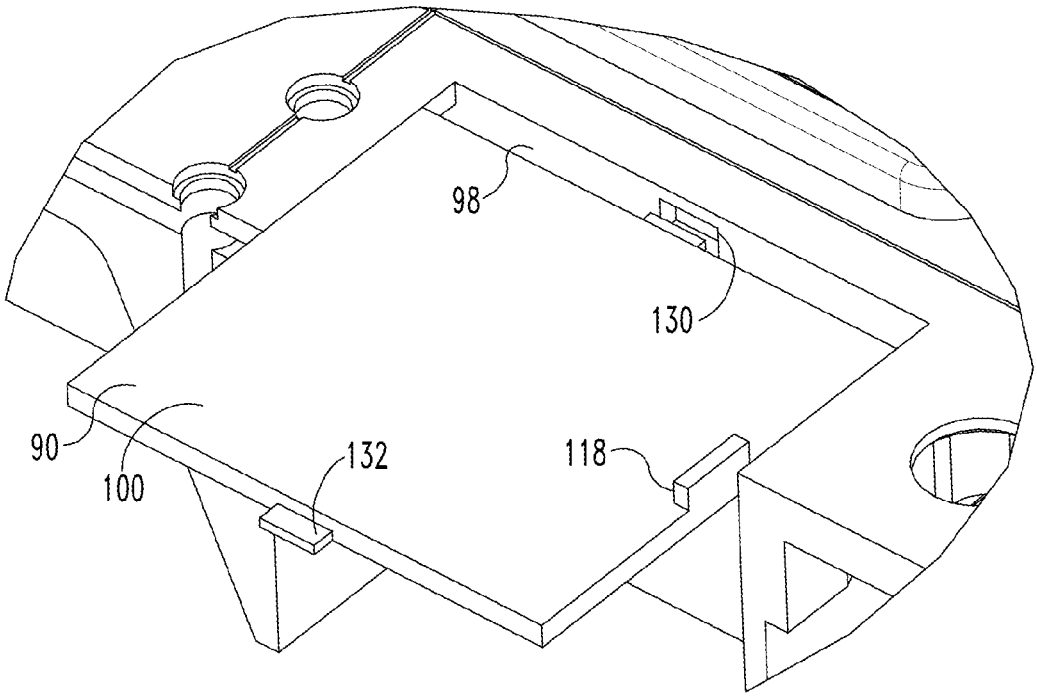
FIG. 6 is a detail isometric view of another embodiment of the door member and limited opening.

In another alternate embodiment, the channel 110 is again defined by the top sidewall 62 and the inner planar member 120 and the channel 110 extends along the limited opening lateral sides 98, 99. In this embodiment, as shown in FIG. 6, however, the top sidewall 62 includes a number of additional pockets 130 extending upwardly into the top sidewall 62 at locations adjacent the limited opening 92. The translating door member 100 includes a number of lateral tabs 132 extending generally perpendicular to the direction of travel of the translating door member 100. The tabs 132 are less than the thickness of the translating door member 100. In an exemplary embodiment, the tabs 132 are about half as thick as the translating door member 100. The pockets 130 are sized and shaped to correspond to the tabs 132. The pockets 130 are positioned along the channel 110 so that, when the translating door member 100 is in the second position, the tabs 132 are disposed at the pockets 130. Further, the accessory component 80 that is disposed in vault 70 includes a biasing device 134, such as, but not limited to, a leaf spring 136 disposed on the upper surface of the accessory component 80. The biasing device 134 is structured to engage and bias the translating door member 100 toward the top sidewall 62.

In this configuration, the translating door member 100 moves from the first position to the second position with the biasing device 134 biasing the translating door member 100 toward the top sidewall 62. When the translating door member 100 reaches the second position, the tabs 132 are aligned with the pockets 130. Thus, the bias of the biasing device 134 moves the translating door member 100 toward the top sidewall 62 while moving the tabs 132 into the pockets 130. As noted above, in this embodiment the top sidewall 62 and the inner planar member 120 are, collectively, "the planar member defining the limited opening." Thus, the translating door member 100 is disposed in the limited opening 92. In this embodiment, however, the outer surface of the translating door member 100 is disposed substantially in the same plane as the outer surface of top sidewall 62.

Figure 7:
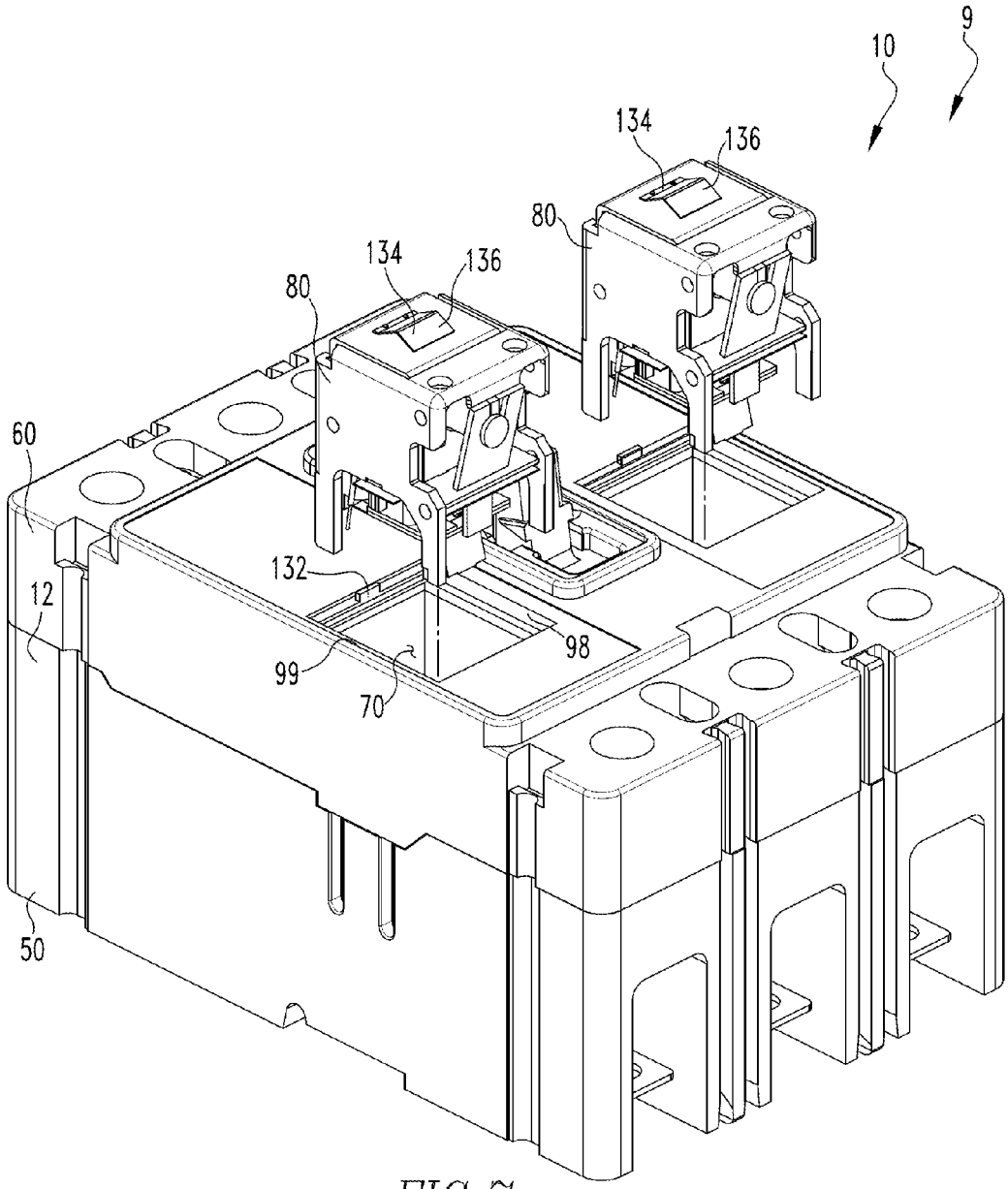
FIG. 7 is an isometric view of an alternate embodiment of an electrical switching apparatus with the door member in the first position.
Figure 8:
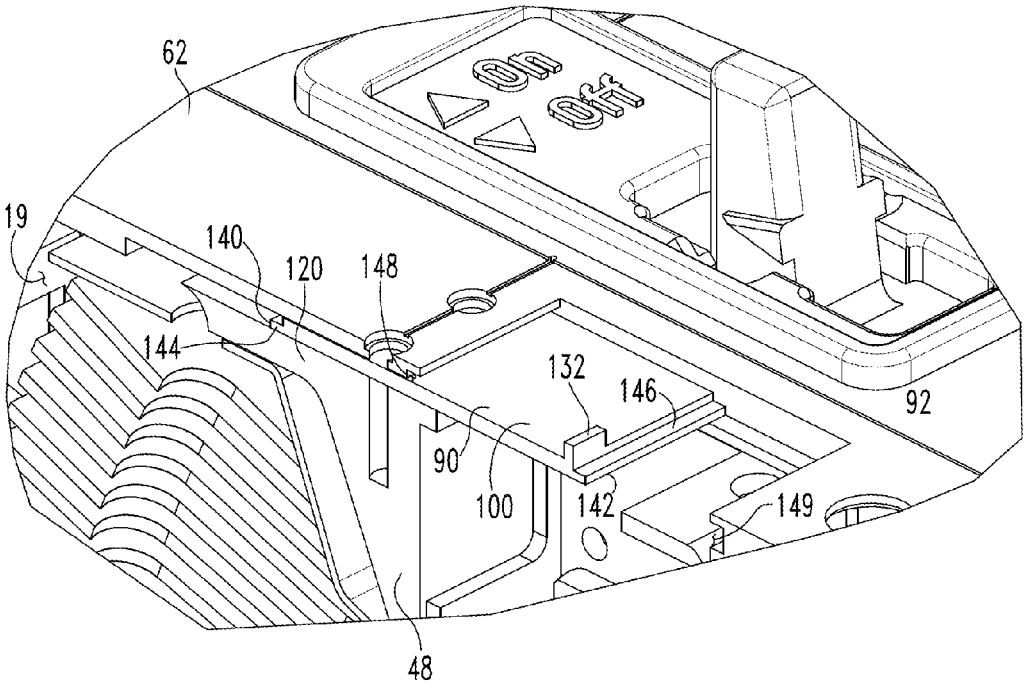
FIG. 8 is a detail isometric view of the door of FIG. 7.
Figure 9:
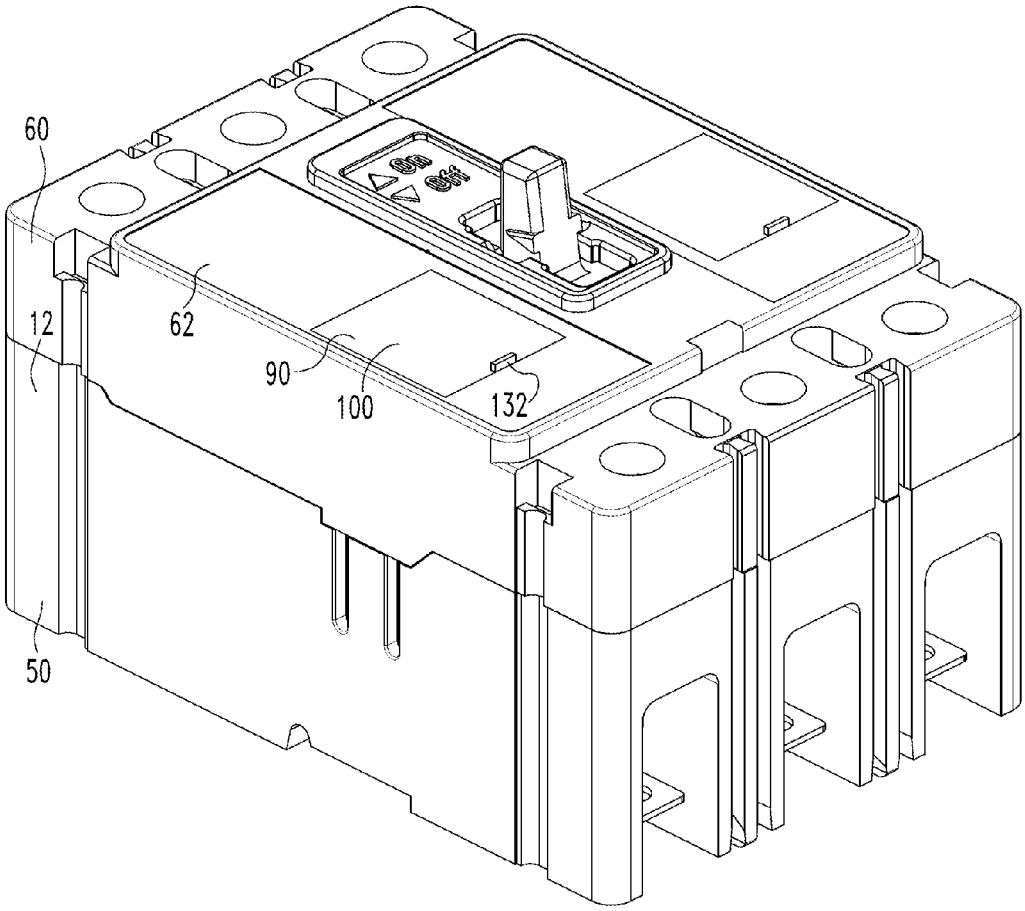
FIG. 9 is an isometric view of an alternate embodiment of an electrical switching apparatus with the door member in the second position.

In another alternate embodiment, shown in FIGS. 7-9, the channel 110 is again defined by the top sidewall 62 and the inner planar member 120. In this embodiment, the translating door member 100 includes a front side 140 and a back side 142. The translating door member 100 front side 140 and back side 142 each include a ledge 144, 146 (FIG. 8). That is, the translating door member 100 includes extensions along the front side 140 and a back side 142 wherein the extension is less thick than the door member 100, thereby defining the ledges 144, 146. In an exemplary embodiment, the inner surface of the ledges 144, 146 is substantially aligned with the plane of the inner surface of the door member 100. Further, the top sidewall 62 includes cavities 148, 149 disposed along the limited opening front side 96 and limited opening back side 97. The cavities 148, 149 are sized and shaped to correspond to the ledges 144, 146. As in the prior embodiment, the accessory component 80 includes a biasing device 134 that engages the translating door member 100 and biases the door member 100 upwardly.

In this configuration, when the translating door member 100 moves from the first position (FIG. 7) to the second position (FIG. 9), the biasing device 134 biases the door upwardly. The user counteracts the bias during the motion of the translating door member 100 until the translating door member is immediately adjacent the second position, i.e., when the translating door member extends over the limited opening 92. At that time, the user releases the counter biasing force allowing the door member 100 to move upwardly. This motion moves the ledges 144, 146 into the cavities 148, 149 thereby trapping the translating door member 100 in the second position.

Figure 10:
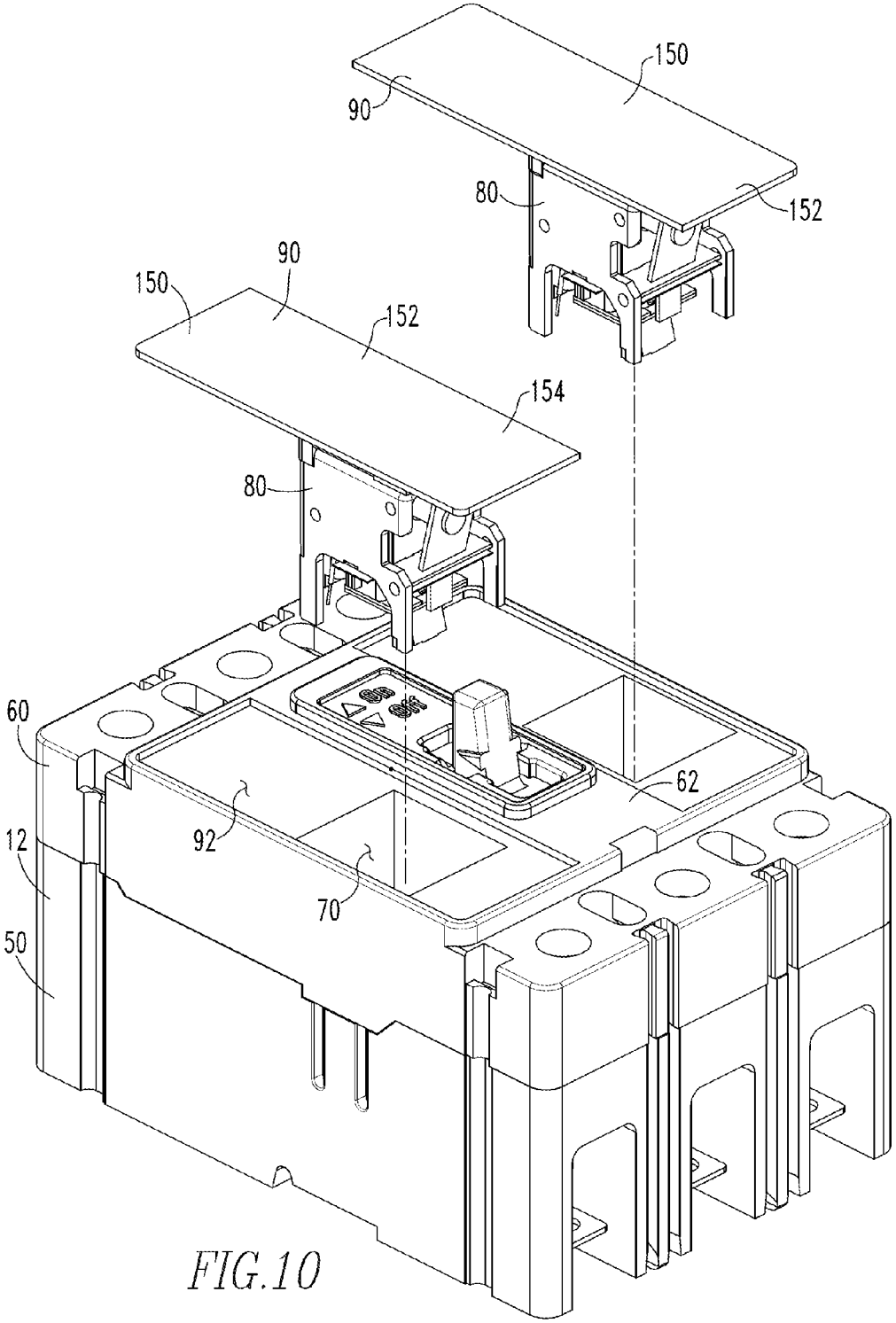
FIG. 10 is an isometric view of an alternate embodiment of an electrical switching apparatus with the door member in the first position.
Figure 11:
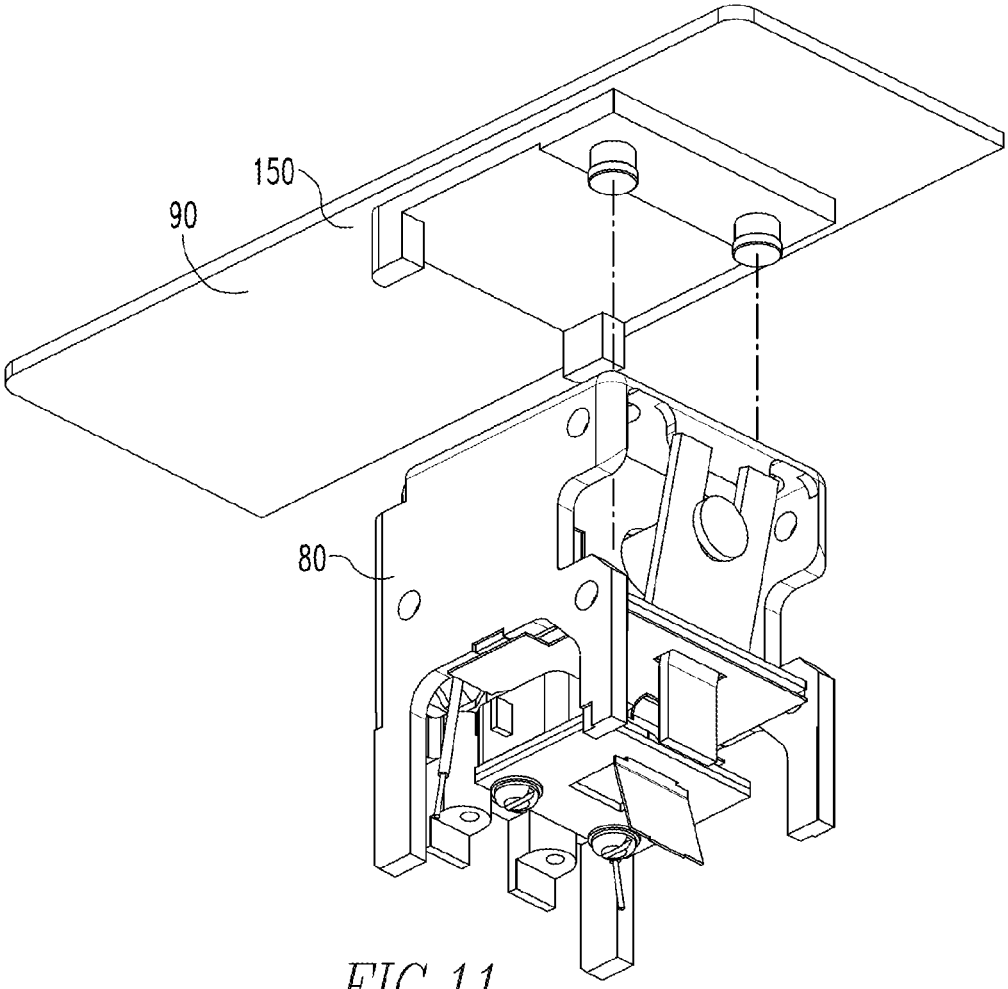
FIG. 11 is a detail isometric view of the door of FIG. 10.
Figure 12:
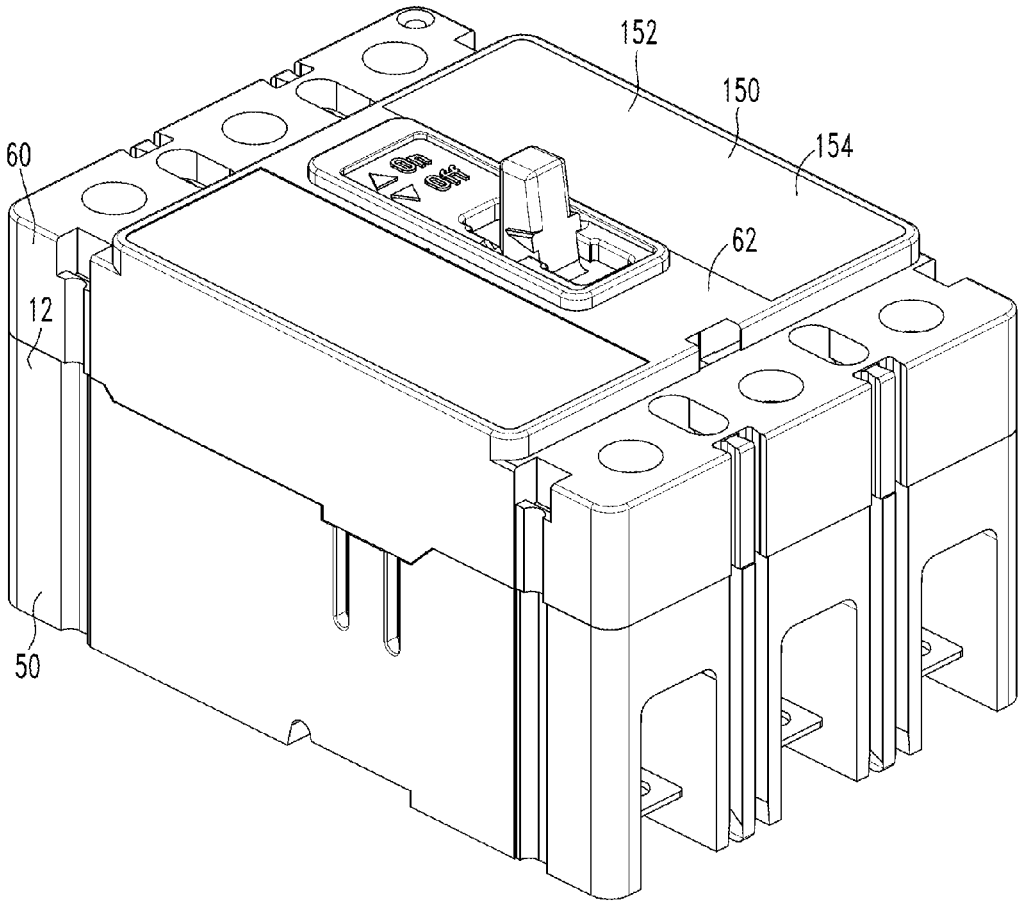
FIG. 12 is an isometric view of an alternate embodiment of an electrical switching apparatus with the door member in the second position.

In another exemplary embodiment, shown in FIGS. 10-12, the movable door member 90 is coupled, directly coupled or fixed, to the accessory component 80. In an exemplary embodiment, not shown, the movable door member 90 has a cross-sectional area generally corresponding to the cross-sectional area of the accessory component 80. In this embodiment, the limited opening 92 has a cross-sectional area that is slightly larger than the accessory component 80. Thus, the door member 90 also has a cross-sectional area that is slightly larger than the accessory component 80. In this configuration, when the accessory component 80 is in the first position, the door member 90 is in its first position, and, when the accessory component 80 is in the second position, the door member 90 is in its second position.

In the exemplary embodiment shown, the movable door member 90 has a cross-sectional area that is larger than the cross-sectional area of the accessory component 80. In this embodiment, the movable door member 90 is an orienting door member 150. In an exemplary embodiment, the orienting door member 150 includes a generally rectangular, planar body 152. Further, in this embodiment, the limited opening 92 defined by the top sidewall 62 is sized to correspond to the orienting door member 150. As shown in FIG. 10, the limited opening 92 has a cross-sectional area that is larger than the cross-sectional area of the vault 70. Moreover, the vault 70 is not centrally disposed relative to the limited opening 92. That is, the vault 70 is disposed asymmetrically relative to the shape of the limited opening cross-sectional area. In this configuration, the orienting door member 150 will only fit into the limited opening 92 in a specific orientation. That is, for example, if the orienting door member 150 was rotated about a generally vertical axis 180 degrees from the orientation shown in FIG. 10, either the accessory component 80 would not align with the vault 70, or, the orienting door member 150 would not align with the limited opening 92. Accordingly, for a user to install the accessory component 80 and have the orienting door member 150 align with the limited opening 92, the user must position the accessory component 80 and the orienting door member 150 in the proper orientation. This configuration is colloquially identified as "idiot-proof" because when the accessory component 80 in not in the proper orientation, a visual comparison of the orienting door member 150 relative to the limited opening 92 provides an easily visible indication of the improper orientation. In this embodiment, the orienting door member 150 can be secured to the switching apparatus housing assembly 12 by a fastener or by a snap-fit coupling, not shown.

Further, in this configuration an outer surface 154 of the orienting door member 150 is large enough, i.e. has a minimum area of about two square inches, to act as a labeling surface. That is, an indicia (not shown), e.g. text, numbers designs, and/or symbols, may be disposed on or incorporated into the orienting door member outer surface 154. It is noted, however, that the orienting door member 150 may be smaller than the full length of the electrical switching apparatus housing assembly 12.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An electrical switching apparatus housing assembly for an electrical switching apparatus assembly, said electrical switching apparatus housing assembly comprising:
- a body assembly including a number of outer walls;
- said outer walls defining an enclosed space;
- said outer walls including a top sidewall;
- said top sidewall including a limited opening to said enclosed space;
- a movable door member, said door member movably coupled to said top sidewall; and
- wherein said door member is movable between an open, first position, wherein said door member is not disposed in said limited opening, and a closed, second position, wherein said door member is disposed in said limited opening.

2. The electrical switching apparatus housing assembly of claim 1 wherein:
- said top sidewall is generally planar; and
- said door member is generally planar.

3. The electrical switching apparatus housing assembly of claim 1 wherein:
- said body assembly includes a number of internal sidewalls;
- said internal sidewalls defining a vault; and
- wherein said limited opening provides access to said vault.

4. The electrical switching apparatus housing assembly of claim 1 wherein said door member includes a locking component.

5. The electrical switching apparatus housing assembly of claim 1 wherein said door member is slidably coupled to said top sidewall.

6. The electrical switching apparatus housing assembly of claim 5 wherein said door member is a translating door member.

7. The electrical switching apparatus housing assembly of claim 5 wherein:
- said top sidewall defines a number of channels, said number of channels disposed adjacent said limited opening; and
- said door member is slidably disposed in said number of channels.

8. The electrical switching apparatus housing assembly of claim 7 wherein said electrical switching apparatus assembly includes an operating mechanism handle, wherein said operating mechanism handle pivots in a plane, and wherein said door member moves generally linearly in a direction selected from the group including a direction substantially parallel to the operating mechanism handle plane of motion and substantially perpendicular to the operating mechanism handle plane of motion.

9. The electrical switching apparatus housing assembly of claim 1 wherein said door member is an orienting door member.

10. The electrical switching apparatus housing assembly of claim 9 wherein said circuit breaker includes an accessory component, wherein said accessory component is movable between a first position, wherein said accessory component is not disposed in a vault, and a second position, wherein said accessory component is disposed in said vault, and wherein:

said body assembly includes a number of internal sidewalls;

said internal sidewalls defining a vault;

wherein said limited opening provides access to said vault;

said limited opening has a cross-sectional area;

said vault is disposed asymmetrically relative to the shape of said limited opening cross-sectional area;

said orienting door member is directly coupled to said accessory component;

wherein, when said accessory component is in said first position, said orienting door member is spaced from said limited opening; and wherein, when said accessory component is in said second position, said orienting door member is disposed in said limited opening.

11. An electrical switching apparatus comprising:

an electrical switching apparatus housing assembly defining an enclosed space;

a number of fixed contacts and a number of movable contacts, wherein each said movable contacts is movable between an open, first position, wherein the movable contact is spaced from a fixed contact, and, a closed, second position, wherein the movable contact is directly coupled to, and in electrical communication with, a fixed contact;

an operating mechanism, wherein said operating mechanism is operatively coupled to each movable contact and is structured to move each movable contact, said operating mechanism movable between two configurations, a first configuration, wherein each the movable contact is spaced from a fixed contact, and, a closed, second configuration, wherein each movable contact is directly coupled to, and in electrical communication with, a fixed contact and wherein said operating mechanism is biased toward said first configuration;

said electrical switching apparatus housing assembly including:

a body assembly including a number of outer sidewalls;

said outer sidewalls defining an enclosed space;

said outer sidewalls including a top sidewall;

said top sidewall including a limited opening to said enclosed space;

a movable door member, said door member movably coupled to said top sidewall; and wherein said door member is movable between an open, first position, wherein said door member is not disposed in said limited opening, and a closed, second position, wherein said door member is disposed in said limited opening.

12. The electrical switching apparatus of claim 11 wherein:

said top sidewall is generally planar; and said door member is generally planar.

13. The electrical switching apparatus of claim 11 wherein:

said body assembly includes a number of internal sidewalls;

said internal sidewalls defining a vault; and wherein said limited opening provides access to said vault.

14. The electrical switching assembly of claim 11 wherein said door member includes a locking component.

15. The electrical switching apparatus of claim 11 wherein said door member is slidably coupled to said top sidewall.

16. The electrical switching apparatus of claim 15 wherein said door member is a translating door member.

17. The electrical switching apparatus of claim 15 wherein:

said top sidewall defines a number of channels, said number of channels disposed adjacent said limited opening; and said door member is slidably disposed in said number of channels.

18. The electrical switching apparatus of claim 17 wherein said electrical switching apparatus assembly includes an operating mechanism handle, wherein said operating mechanism handle pivots in a plane, and wherein said door member moves generally linearly in a direction selected from the group including a direction substantially parallel to the operating mechanism handle plane of motion and substantially perpendicular to the operating mechanism handle plane of motion.

19. The electrical switching apparatus of claim 11 wherein said door member is an orienting door member.

20. The electrical switching apparatus of claim 19 wherein said circuit breaker includes a accessory component, wherein said accessory component is movable between a first position, wherein said accessory component is not disposed in a vault, and a second position, wherein said accessory component is disposed in said vault, and wherein:

said body assembly includes a number of internal sidewalls;

said internal sidewalls defining a vault;

wherein said limited opening provides access to said vault;

said limited opening has a cross-sectional area;

said vault is disposed asymmetrically relative to the shape of said limited opening cross-sectional area;

said orienting door member is directly coupled to said accessory component;

wherein, when said accessory component is in said first position, said orienting door member is spaced from said limited opening; and wherein, when said accessory component is in said second position, said orienting door member is disposed in said limited opening.

* * * * *